US008144304B2

(12) United States Patent
Lin et al.

(10) Patent No.: US 8,144,304 B2
(45) Date of Patent: Mar. 27, 2012

(54) APPARATUS AND METHOD FOR DRIVING A FLAT PANEL DISPLAY AND REPAIRING A FLAT PANEL DISPLAY SIGNAL LINE

(75) Inventors: Wen-Tsung Lin, Tainan (TW); Yung-Li Huang, Tainan (TW)

(73) Assignee: Chimei Innolux Corporation (TW)

( * ) Notice: Subject to any disclaimer, the term of this patent is extended or adjusted under 35 U.S.C. 154(b) by 1225 days.

(21) Appl. No.: 11/523,152

(22) Filed: Sep. 19, 2006

(65) Prior Publication Data

US 2007/0063951 A1 Mar. 22, 2007

(30) Foreign Application Priority Data

Sep. 20, 2005 (TW) ..... 94132411 A

(51) Int. Cl.
*G02F 1/13* (2006.01)
*G02F 1/1333* (2006.01)
*G02F 1/1343* (2006.01)

(52) U.S. Cl. ..... 349/192; 349/54; 349/55

(58) Field of Classification Search ..... 349/54–55, 349/192; 345/904
See application file for complete search history.

(56) References Cited

U.S. PATENT DOCUMENTS 5,859,679 A 1/1999 Song
6,429,910 B1 8/2002 Hirata et al.
6,937,296 B2 8/2005 Mizumura et al.
2001/0026332 A1 10/2001 Kida
2005/0110738 A1* 5/2005 Kim et al. ..... 345/100

FOREIGN PATENT DOCUMENTS

| | | |
|---|---|---|
| CN | 1648728 | 8/2005 |
| EP | 0806727 | 11/1997 |
| GB | 2315355 | 1/1998 |
| JP | 04-127127 | 4/1992 |
| JP | 08-171081 | 7/1996 |
| TW | 544539 | 8/2003 |
| WO | WO02/065203 | 8/2002 |

* cited by examiner

*Primary Examiner* — Nathanael R Briggs
(74) *Attorney, Agent, or Firm* — Trop Pruner & Hu, P.C.

(57) ABSTRACT

An apparatus is for use in a display device having a defective signal line with a defect that isolates a first signal line portion from a second signal line portion of the defective signal line. The apparatus includes a signal driver that has a driver output terminal electrically connected to the first signal line portion, and a first repair buffer having an input terminal and an output terminal. A repair line is electrically connected to the output terminal of the first repair buffer. The input terminal of the first repair buffer is initially electrically isolated from the defective signal line. To repair the defective signal line, the input terminal of the first repair buffer is electrically connected to the defective signal line to enable a signal from the signal driver to travel through the first repair buffer over the repair line to the second signal line portion of the defective signal line.

20 Claims, 7 Drawing Sheets

APPARATUS AND METHOD FOR DRIVING A FLAT PANEL DISPLAY AND REPAIRING A FLAT PANEL DISPLAY SIGNAL LINE

CROSS REFERENCE TO RELATED APPLICATION

This claims priority under 35 U.S.C. §119 of Taiwan Application No. 094132411, filed Sep. 20, 2005.

TECHNICAL FIELD

The present invention relates repairing signal lines, such as those in flat panel displays.

BACKGROUND

Liquid crystal display (LCD) devices typically include an LCD panel having a liquid crystal layer sandwiched between a thin-film transistor (TFT) substrate and an opposing substrate. The TFT substrate has an array of TFTs for controlling respective pixels of the LCD panel to control the amount of light passing through the liquid crystal layer. The TFTs are coupled to signal lines, scan lines and data lines, where scan lines are used to turn corresponding TFTs on and off, while data lines are used to apply voltages to respective pixels.

During manufacture of an LCD panel, a signal line defect can occasionally occur. For example, FIG. 1 shows a substrate 200 containing an array of TFTs corresponding to an array of pixels of the LCD panel. As depicted, the array of TFTs are driven by signal lines, including scan lines (running in rows horizontally in FIG. 1) and data lines (running in columns vertically in FIG. 1). In the example of FIG. 1, a defective signal line (in this case a defective data line) has a defect 108, which is a break in the signal line. As a result of the break defect 108 in the defective signal line, two signal line portions 120 and 130 in the defective signal line are disconnected and separated from each other. Although the signal line portion 120 still may be used for transmitting signals sent out by a signal driver 102 (since the signal line portion 120 remains connected to the signal driver 102), the other signal line portion 130 is electrically isolated from the driver 102 due to the break defect 108. As a result, the section of the LCD panel (that corresponds to signal line portion 130) cannot display properly, which will adversely affect the image displayed by the LCD panel.

A conventional solution for repairing a break defect is shown in FIG. 2. In FIG. 2, 208 indicates a signal line break defect in a defective signal line on a substrate 200 containing an array of TFTs driven by scan and data lines. Due to the signal line break defect 208, the defective signal line has two disconnected signal line portions 220 and 230. Note that the defective signal line is driven by a signal driver 202. To repair the defective signal line, laser melting can be used to electrically connect the signal line portion 220 and a lead 240 at the intersection 210 of the signal line portion 220 and the lead 240 (note that the lead 240 is provided in a separate metal layer than the defective signal line). Laser melting refers to using laser to cause an opening to be formed through an electrically insulating layer between the defective signal line and the lead 240, such that melting of electrically conductive material of the defective signal line and/or lead 240 will cause a flow of the electrically conductive material into the opening in the electrically insulating layer. As a result of the laser melting (or laser bonding) procedure, the lead 240 is electrically connected to the signal driver 202.

In this manner, the lead 240 transmits the output signal of the driver 202 to a line 205, which can be on a printed circuit board 251. The lead 240 is electrically connected to the line 205 through another lead 245, which can be a lead provided by the package (e.g., COF or TCP) of the driver 202. The signal through the leads 240, 245, and line 205 is provided to the input terminal of a buffer 214. The output terminal of the buffer 214 is connected to a line 215 (running vertically along a side of the TFT array in FIG. 2), which is in turn connected to a line 270. The line 270 runs horizontally along the bottom side of the TFT array, and is located at the ends of the data lines on the substrate 200 (at the ends of the data lines opposite to the ends of the data lines driven by corresponding signal drivers). At the intersection 212 of the line 270 and the signal line portion 230, laser melting is used to electrically connect the signal line portion 230 and the line 270. In this manner, the output terminal of the buffer 214 is electrically connected to the line 270, such that the output signal of the signal driver 202 is able to reach the signal line portion 230 (that was isolated from the driver 202 by the break defect 208). The leads 240, 245, lines 205, 270, and buffer 214 provide an alternate (or repair) path from the signal driver 202 to the signal line portion 230. As a result, the signal line defect 208 can be repaired during the manufacturing process of the LCD panel.

In FIG. 2, note that signal drivers are further associated with corresponding leads 240A, 240C, 240D, 240E, and so forth.

With the arrangement depicted in FIG. 2, parasitic capacitance is formed between leads 240, 240A, 240B, 240C, 240D, and 240E and the data lines of the TFT array in the LCD panel. Also, parasitic capacitance is formed between the leads 245 (provided by the packages of the drivers 202), the line 205 on the printed circuit board 251, and the periphery leads. Therefore, as shown in FIG. 2, there are relatively large parasitic capacitances in the repair path from the output terminal of the signal driver 202 to the input terminal of the buffer 214. As a result, the output signal of the signal driver 202 transmitted to the input terminal of the buffer 214 is delayed and deformed (e.g., reduced rise and falls times), which can affect the quality of the displayed image by the LCD panel that has been repaired. One way to solve this problem is enhancing the driving ability of all the output stages of the signal drivers. However, to do so, the size of the signal drivers will have to be enlarged, which leads to increased manufacturing cost, power consumption, and electromagnetic interference.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION

Figure 3:
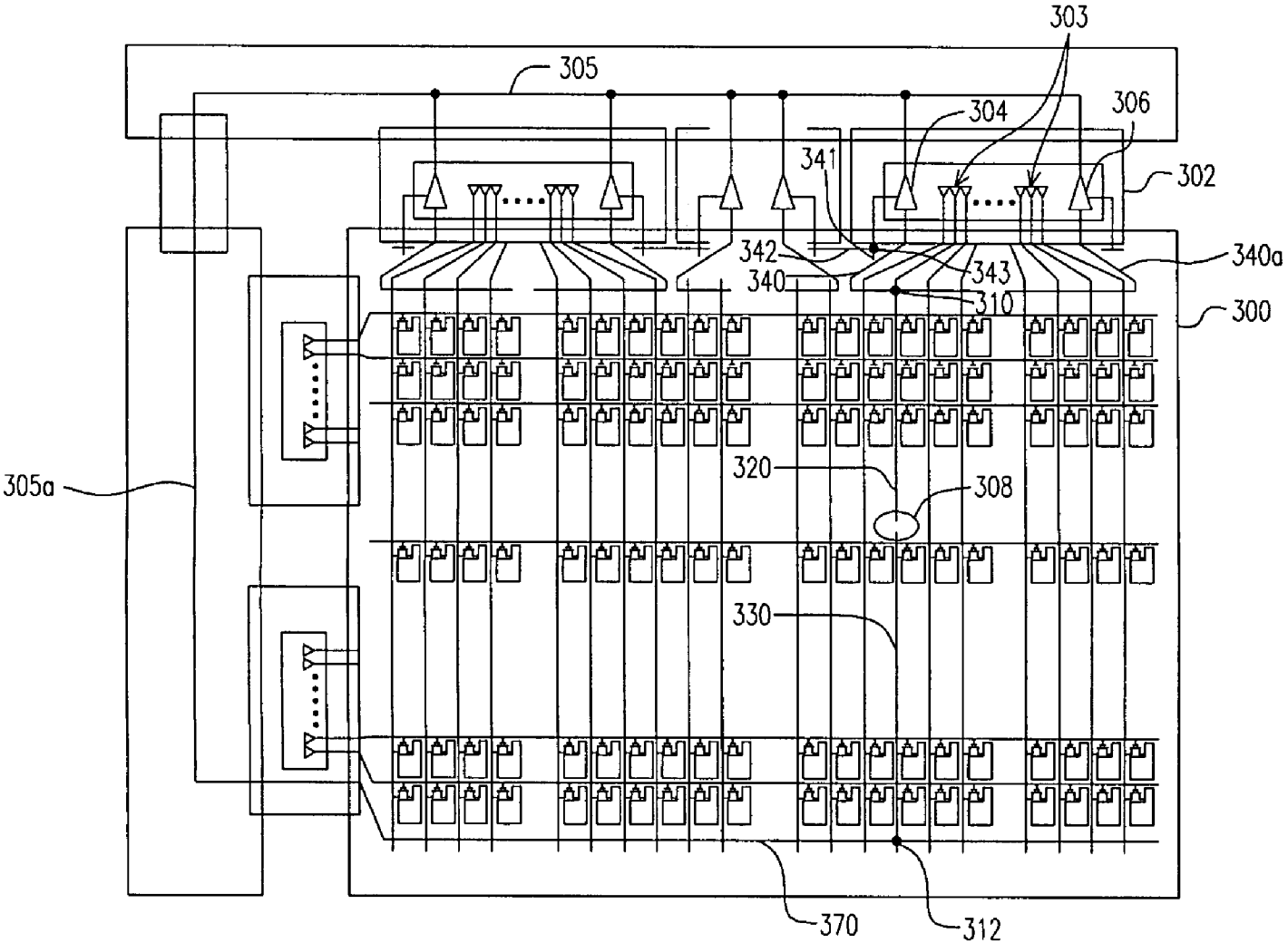
FIG. 3-7 are schematic diagrams of circuitry for driving a flat panel display and circuitry for repairing a signal line in the flat panel device, according to various embodiments.

FIG. 3 depicts a liquid crystal panel having a substrate 300 and signal drivers to drive signal lines (scan lines and data lines) in the liquid crystal panel. Although reference is made to liquid crystal panels, it is noted that some embodiments can be applied for use in other types of flat panel devices (or any other type of display device). The substrate 300 has an array of thin-film transistors (TFTs) for controlling respective pixels of the liquid crystal panel 300. The TFTs are electrically connected to data lines (which drive voltages of respective pixels) and scan lines (which control respective TFTs by turning them on or off). The term "electrically connect" refers to either a direct connection or a connection through one or more intervening elements to achieve electrical communication. The signal drivers along the top of the TFT array (in the orientation of FIG. 3) are used to drive the data lines. The signal drivers along the left side of the TFT array (in FIG. 3) are used to drive the scan lines. Among the signal drivers is a signal driver 302.

The signal driver 302 includes driving circuitry 303 for driving corresponding data lines, as depicted in FIG. 3. Additionally, according to some embodiments, the signal driver 302 further includes repair buffers 304 and 306, each controlled by a respective enable signal. Although two repair buffers are shown in each signal driver, it is noted that a different number (one or three or greater) or repair buffer(s) can be used in other embodiments. The enable signal controls activation or deactivation of the corresponding buffer 304, 306. When the buffers 304 and 306 are activated under the control of enable signals, the signal voltage on the output terminals of the buffers is the same as that on the input terminals. Each buffer 304, 306 has a relatively large current driving capability. When the buffers 304 and 306 are not activated under the control of the enable signals, the output terminals of the buffers are at a state of high impedance. As discussed further below, the enable signals are used to activate one or more buffers 304, 306 in the signal driver 302 to enable the repair of a defective signal line.

As depicted in FIG. 3, a defective signal line has a signal line break defect 308 that causes the formation of two disconnected (electrically isolated) signal line portions 320 and 330. Since the signal line portion 320 remains electrically connected to the signal driver 302, the signal line portion 320 still can be used to normally transmit signals sent out by the driver 302 to corresponding TFTs connected to the signal line portion 320. However, the signal line portion 330 is isolated from the driver 302 and cannot transmit the signals outputted by the driver 302 due to the signal line break defect 308. To enable repair of the defective signal line, a lead 340 (which initially is floating over the defective signal line) is provided. The lead 340 floating over the defective signal line means that at least a part of the lead 340 is located over a part of the defective signal line, with the lead 340 isolated from the defective signal line by an intervening electrically insulating layer. Repair is accomplished by electrically connecting the lead 340 and the signal line portion 320 at intersection 310, such as by using laser melting (or laser bonding) or some other technique. Laser melting or laser bonding refers to using laser to cause an opening to be formed through an electrically insulating layer between the defective signal line and the lead 340, such that melting of electrically conductive material of the defective signal line and/or lead 340 will cause a flow of the electrically conductive material into the opening in the electrically insulating layer. As a result of the laser melting (or laser bonding) procedure, the lead 340 is electrically connected to the signal driver 202. After the laser melting (or laser bonding) procedure, the signal line portion 320 is electrically connected to the input terminal of the buffer 304 in the driver 302, through the intersection 310 and lead 340. The enable signal of the buffer 304 is set at an active level to activate the buffer 304. The activated buffer 304 is able to drive line 305 with the signal appearing on the defective signal line portion 320 (as driven by the signal driver 302).

The line 305 runs horizontally (in the orientation of FIG. 3) along an upper side of the TFT array. The line 305 is electrically connected to another line 305*a* (that runs vertically in the orientation of FIG. 3 along a left side of the TFT array. The line 305*a* is in turn electrically connected to a line 370 that runs horizontally in the orientation of FIG. 3 along a lower side of the TFT array.

The lead 340, repair buffer 304 (or other similar repair buffer in any signal driver, and lines 305, 305*a*, and 370 collectively are referred to as a "repair line" or "repair path." Note that "repair line" can refer to the elements listed above collectively, or to any one or more of the lead 340, repair buffer 304, and lines 305, 305*a*, and 370. Although some embodiments for repairing signal lines are applied to data lines, it is noted that similar repair mechanisms can be applied to scan lines.

While the repair buffer 304 is maintained at an activated state, other repair buffers having output terminals connected to the line 305 are maintained at an inactivated state (high impedance), thus avoiding interference between the output terminals of the repair buffers. In addition, the output of the repair buffer 304 is electrically connected to the other side of the panel through the lines 305, 305*a*, and 370. The line 370 is provided adjacent ends of the signal lines opposite other ends of the signal lines connected to the signal drivers. At the intersection 312 of the line 370 and the signal line portion 330, the signal line portion 330 and the lead 370 are electrically connected using laser melting or other technique. Therefore, a signal driven by driver 302 onto the signal line portion 320 is also driven to the signal line portion 330, thus effectively achieving the purpose of repairing the defective signal line containing the defect 308.

Figure 1:
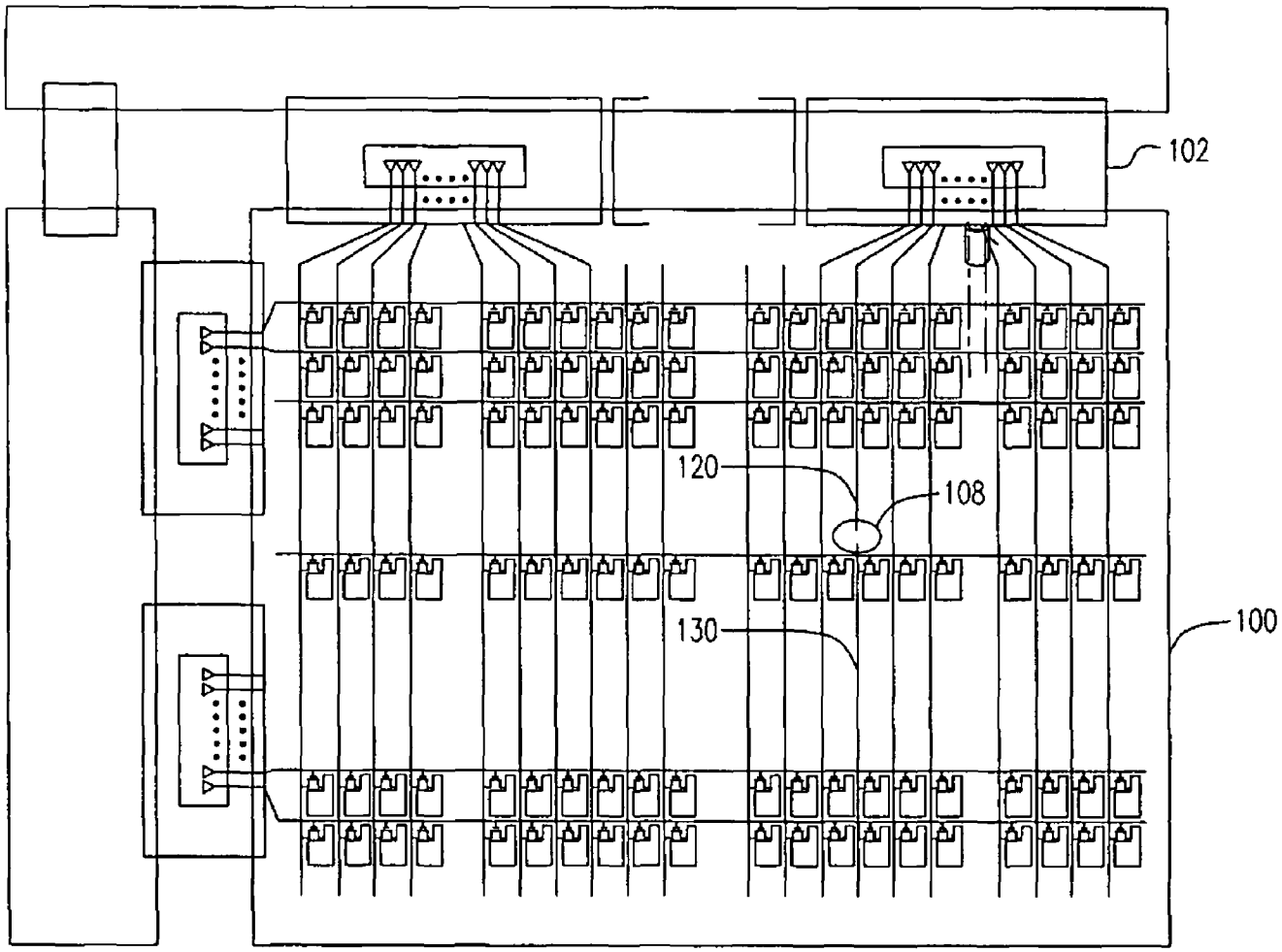
FIG. 1 (PRIOR ART)
FIG. 1 is a schematic diagram of conventional circuitry of a liquid crystal display (LCD) device.
Figure 2:
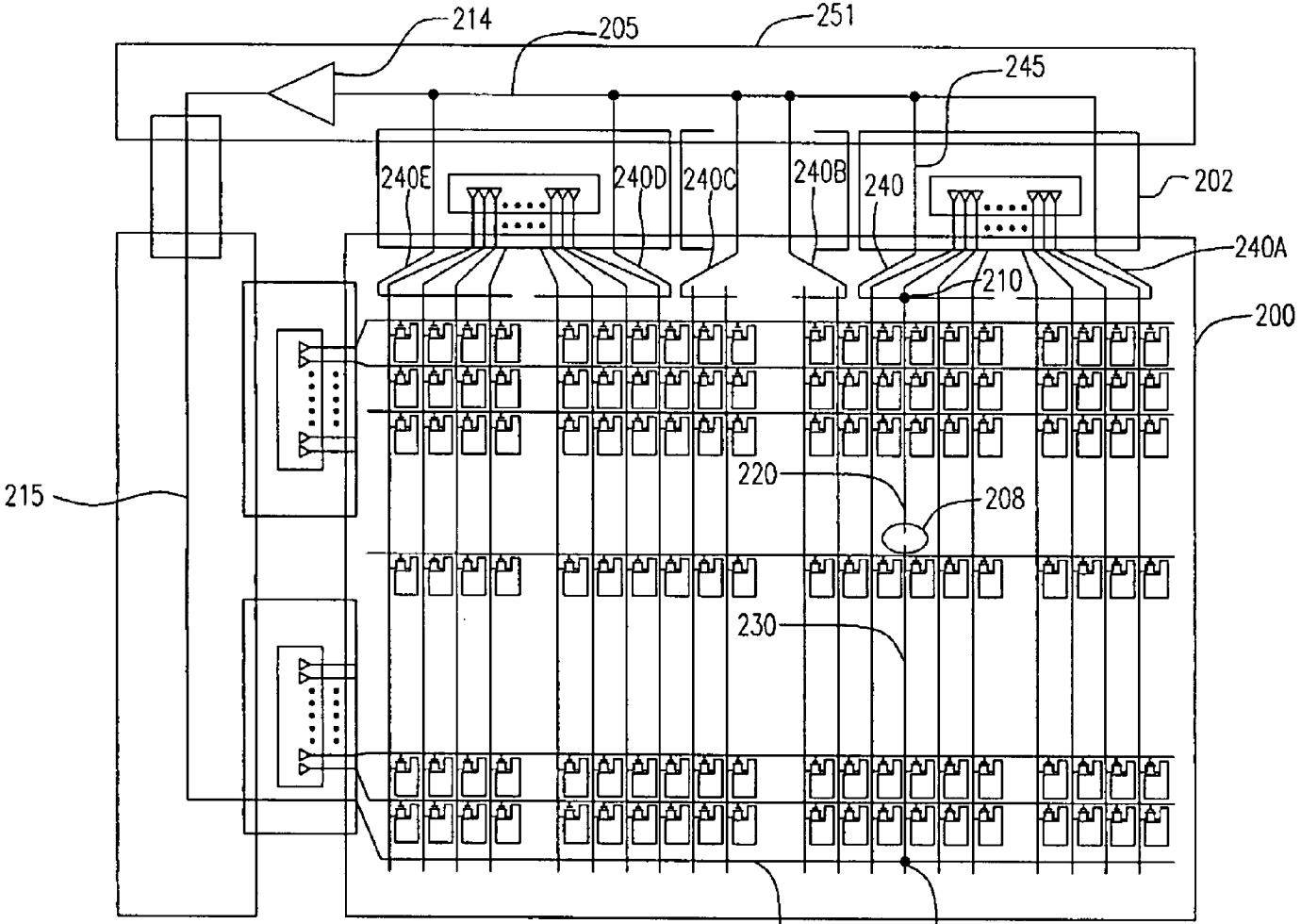
FIG. 2 (PRIOR ART)
FIG. 2 is a schematic diagram of conventional circuitry for repairing a defective signal line in the LCD device.

According to the embodiment of FIG. 3, the parasitic capacitance on the path from the output terminal of the driver 302 to the input terminal of the buffer 304 is less than that of the conventional circuitry used in FIG. 2. As a result, signal delay and deformation is reduced to enhance the quality of the displayed image after repair of the liquid crystal panel. Also, the output stage of the driver is not required to be enlarged in size to allow reduced manufacturing cost, power consumption, and electromagnetic radiation while still providing the ability to effectively repair a signal line defect.

When the enable signal of the repair buffer 304 is floated, the repair buffer 304 is at an inactivated state. The enable signal of the repair buffer 304 is electrically connected to a lead 341 on the LCD panel through the package (TCP or COF) of the driver 302. Initially, the lead 341 is floating over another lead 342, which lead 342 is maintained at a predetermined voltage level. To repair the defective signal line, the leads 341 and 342 are electrically connected at intersection 343, such as by laser melting or other technique. Once electrically connected, the predetermined voltage level of lead 342 is communicated to the enable signal input terminal of the repair buffer 304, such that the repair buffer 304 is set at an activated state for achieving the purpose of signal line repairing.

Figure 4:
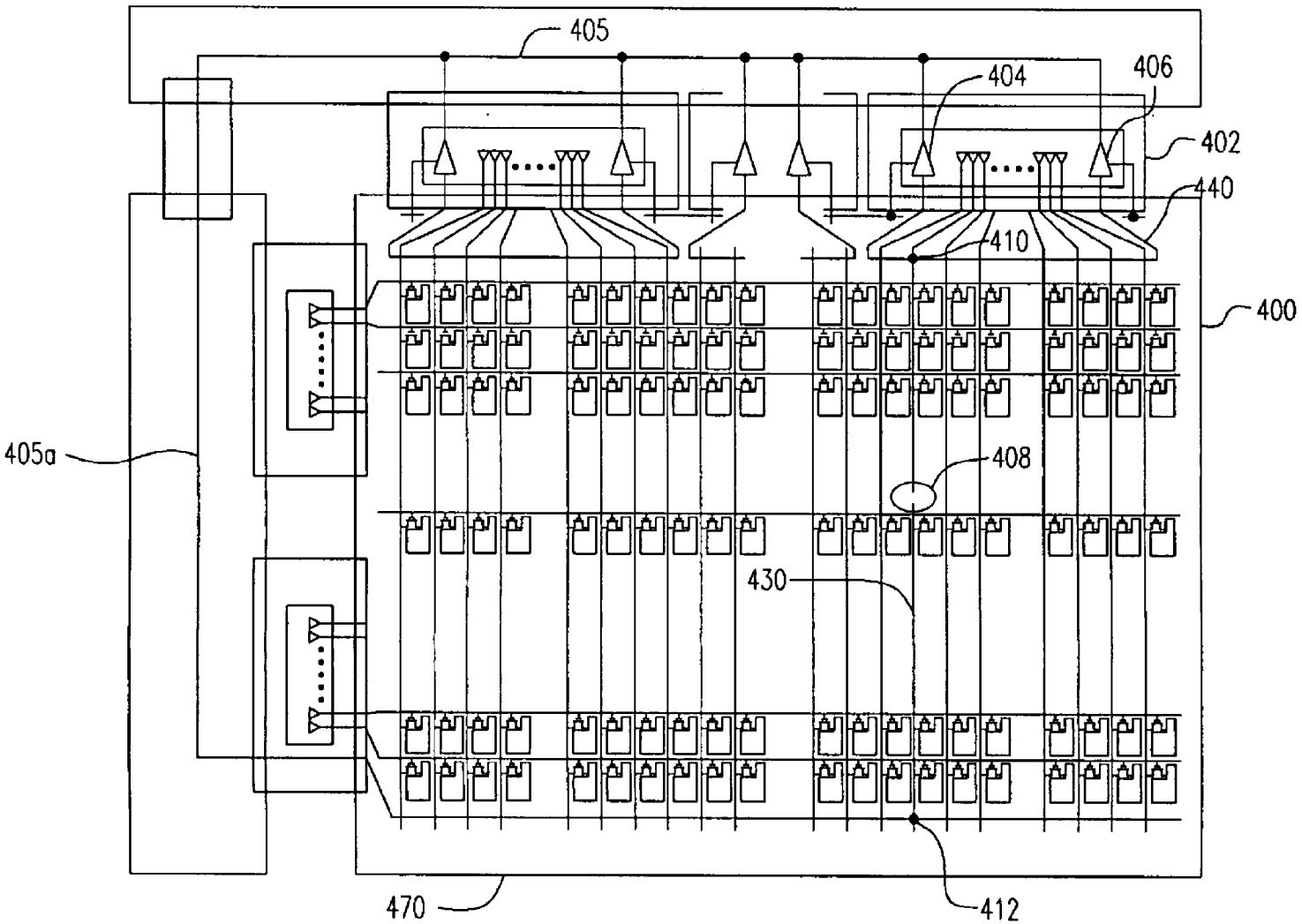

In addition, if the size of the liquid crystal panel is enlarged and a buffer with a larger driving capability is required, the arrangement of FIG. 4 according to another embodiment can be used. Reference is made to both FIGS. 3 and 4 in the following discussion. FIG. 4 shows a liquid crystal panel having a substrate 400 (containing a TFT array) and a break defect 408 of a defective signal line. A difference between the circuitry in FIG. 3 and in FIG. 4 is that, in FIG. 3, each lead 340 that is initially floating over the signal lines covers just some (less than all) of the signal lines driven by the driver 302 (generally half of the signal lines), while in FIG. 4, each lead 440 initially floating on the signal lines covers all the signal lines driven by the driver 402. As shown in FIG. 3, lead 340 extends from the input terminal of the buffer 304 and crosses over a first subset of signal lines (as depicted) driven by the driver 302. Another lead 340*a* crosses over a second subset of the signal lines driven by the buffer 302. In contrast, in FIG. 4, the lead 440 crosses over all of the signal lines driven by the driver 402.

In FIG. 4, at an intersection 410, the signal line portion 420 (which is isolated from the signal line portion 430 by break defect 408) is electrically connected to the lead 440 by laser melting or other technique. This electrical connection causes the output signal from the driver 402 to the defective signal line to drive the input terminals of both the repair buffers 404 and 406 simultaneously. In addition, an enable signal to both repair buffers 404 and 406 is set at an active level such that both repair buffers 404 and 406 are at an activated state. As a result, the output terminals of the repair buffers 404 and 406 both drive the line 405, which is electrically connected to the signal line portion 430 through lines 405*a* and 470 and intersection 412. The arrangement of FIG. 4 (where both repair buffers of a single signal driver are enabled to repair a defective signal line) is contrasted with the arrangement in FIG. 3, where just one of repair buffers 304 and 306 in the signal driver 302 are activated to repair a defective signal line.

Figure 5:
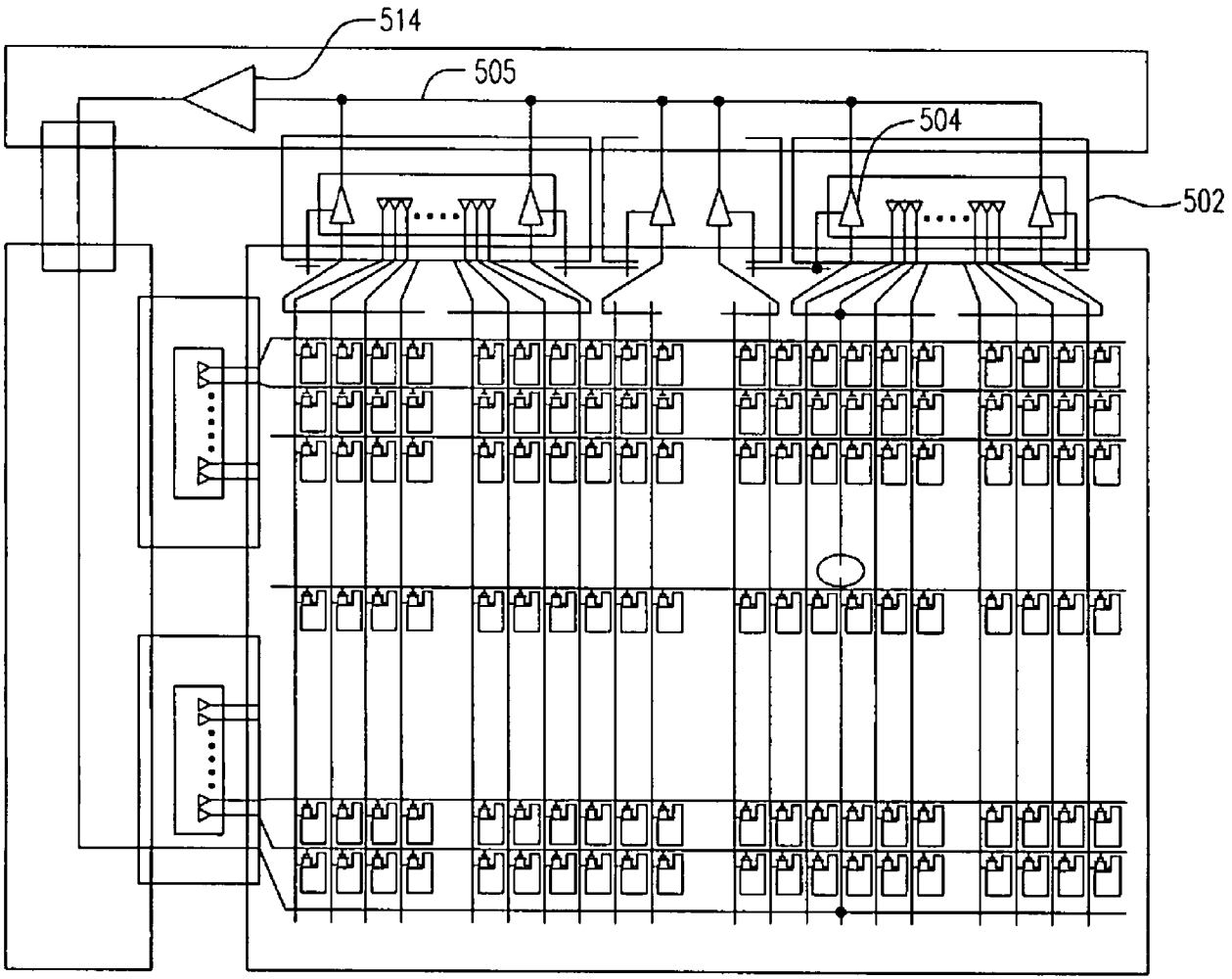

FIG. 5 shows circuitry to drive a flat panel display and to repair signal line defects according to another embodiment. The difference between the circuitry in FIG. 5 and that in FIG. 3 is that the output terminals of the repair buffers 504, 506 in the signal line driver 502 is coupled to an external buffer 514 via lead 505 so as to enhance the driving ability. The external buffer 514 is a buffer located external to the signal driver 502, while repair buffers 504. 506 are internal to the signal driver 502.

Figure 6:
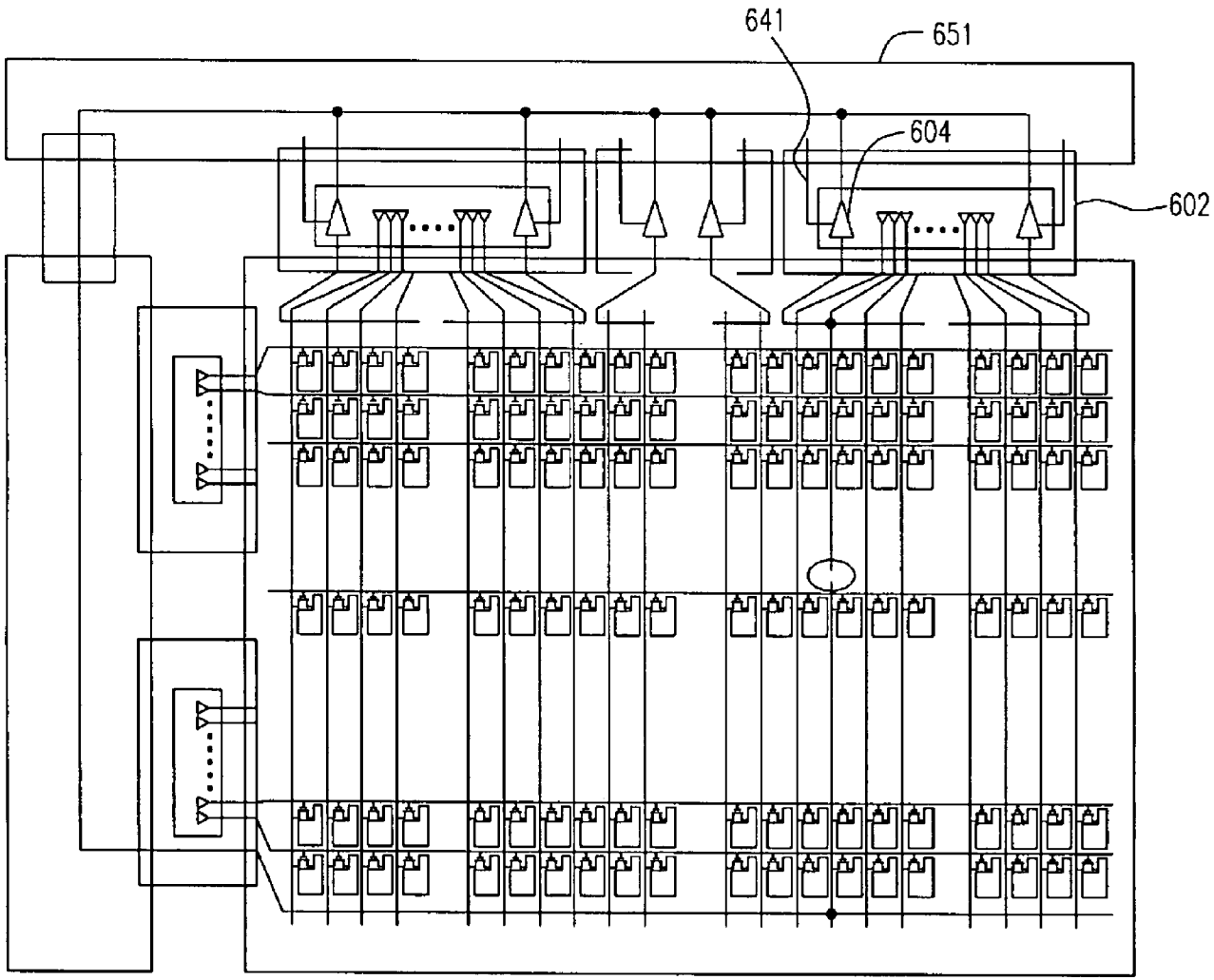

FIG. 6 depicts yet another embodiment of circuitry to drive a flat panel display and to repair signal line defects. The difference between the circuitry in FIG. 6 and that in FIG. 3 is that the enable signal 641 to the repair buffer 604 in the signal line driver 602 is provided by circuitry on a printed circuit board 651; the remaining portions of FIG. 6 are similar to the FIG. 3 circuitry. The printed circuit board 651 is a circuit board in the display device that is different from the circuit board containing the signal drivers.

Figure 7:
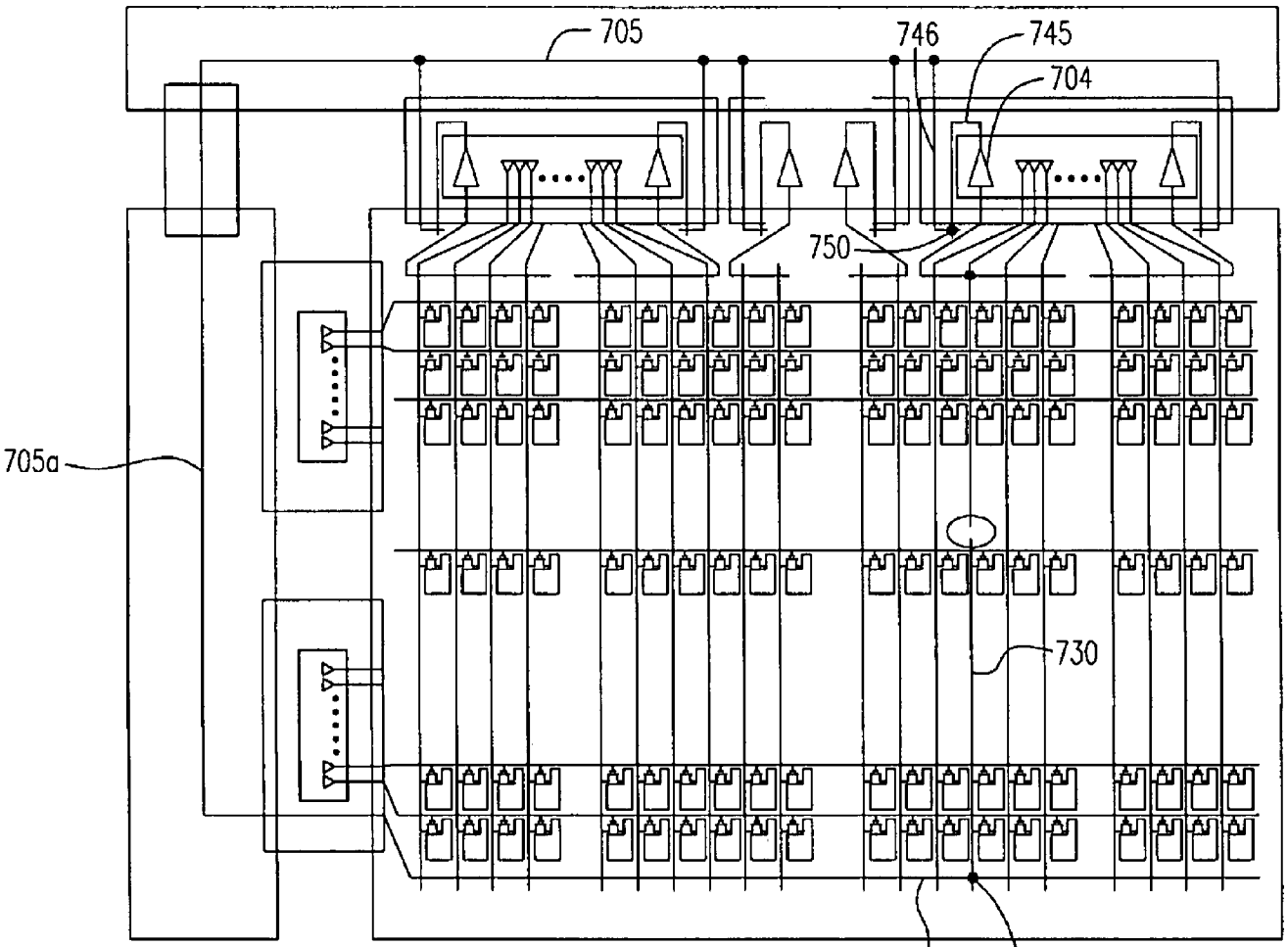

FIG. 7 depicts circuitry to drive a flat panel display and to repair signal line defects according to a further embodiment. The difference between the circuitry of FIG. 7 and that in FIG. 3 is that an enable signal is not utilized in the FIG. 7 embodiment to control repair buffers in the signal line drivers. Each of the repair buffers in the FIG. 7 embodiment is in an activated state; however, only the output terminal of the repair buffer 704 used for repairing a defective signal line is electrically connected to the signal line portion 730 (through lead 746), thereby achieving the purpose of transmitting the driving signal to the other end of the TFT array. Since the output terminal of only the buffer 704 is electrically connected to the signal line portion 730, but the output terminals of the other repair buffers are not electrically to the signal line portion 730, these other buffers do not interfere with the output of the repair buffer 704, even though they are all at an activated state.

To electrically connect the output terminal of the buffer 704 to the signal line portion 730, one end of a lead 745 is connected to the output terminal of the buffer 704, and the other end of the lead 745 extends to an intersection 750 on the LCD panel. One end of a lead 746 is connected to line 705 on the printed circuit board, and the other end of the lead 746 extends to the intersection 750 on the LCD panel. The two leads 745 and 746 thus cross at the intersection 750, where one lead is floated above the other lead. At the intersection 750, the two leads 745, 746 are electrically connected by use of laser melting or other technique, such that the output terminal of the buffer 704 is electrically connected to the lead 705, and further electrically connected to the signal line portion 730 through leads 705*a*, 770 and intersection 712, thereby achieving the purpose of repairing the signal line.

In sum, circuitry to drive a flat panel display and to repair signal line defects includes a repair buffer that is added to a signal line driver. By using the repair buffer, the output driving ability of the signal line driver does not need to be enhanced for the purpose of repairing a defective signal line. The circuitry according to some embodiments reduces interference of a repair line or path to an isolated portion of the defective signal line.

Although each of the embodiments depicted in FIGS. 3-7 depict one repair path, it is noted that other embodiments can employ additional repair paths (configured similarly to the repair mechanism depicted in FIGS. 3-7) to repair other defective signal lines.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. An apparatus for use in a display device having a defective signal line with a defect that isolates a first signal line portion from a second signal line portion of the defective signal line, comprising:

a signal driver to drive a plurality of signal lines and comprising:

a driver output terminal electrically connected to the first signal line portion;

a first repair buffer having an input terminal, a control terminal and an output terminal, wherein when the control terminal receives an enable signal, activation of the first repair buffer is controlled by the enable signal applied to the first repair buffer; and a second repair buffer;

a first lead connected to the first repair buffer and covering a first signal line and a second signal line of the signal lines;

a second lead connected to the second repair buffer and covering a third signal line and a fourth signal line of the signal lines, wherein the first lead does not cover the third and the fourth signal lines and the second lead does not cover the first and the second signal lines; and a repair line, wherein the output terminal of the first repair buffer is electrically connected to one end of the repair line, and the second repair buffer is electrically connected between the driver output terminal and the repair line;

wherein the input terminal of the first repair buffer is initially electrically isolated from the defective signal line, and wherein to repair the defective signal line, the input terminal of the first repair buffer is electrically connected to the defective signal line via the first lead to enable a signal from the signal driver to travel through the first repair buffer over the repair line to the second signal line portion of the defective signal line when the enable signal activates the first repair buffer.

2. The apparatus of claim 1, wherein the input terminal of the first repair buffer is electrically connected to the defective signal line by electrically connecting the input terminal to the first signal line portion.

3. The apparatus of claim 2, wherein the second signal line portion of the defective signal line is initially electrically isolated from the repair line, and wherein to repair the defective signal line, the repair line is electrically connected to the second signal line portion.

4. The apparatus of claim 3, wherein the repair line is electrically connected to the first signal line portion and to the second signal line portion by using laser melting to electrically connect the repair to the first and second signal line portions through an electrically insulating layer.

5. The apparatus of claim 1, wherein activation of the second repair buffer is controlled by the enable signal.

6. The apparatus of claim 5, wherein the first repair buffer is activated whereas the second repair buffer is deactivated to repair the defective signal line.

7. The apparatus of claim 5, wherein both the first and second repair buffers are activated to electrically couple the signal on the first signal line portion to the repair line for repairing the defective signal line.

8. The apparatus of claim 1, further comprising a second buffer external to the driver electrically connected to the repair line, the input of the second buffer driven by the output terminal of the first repair buffer, and the output of the second buffer to drive the second signal line portion.

9. The apparatus of claim 1, further comprising additional signal drivers that comprise additional repair buffers, wherein all repair buffers are in an active state, and wherein just the output terminal of the first repair buffer is electrically connected to the repair line while output terminals of other repair buffers are isolated from the repair line.

10. The apparatus of claim 9, wherein the output terminal of the first repair buffer is electrically connected to the repair line at an interconnection that provides electrical connection based on laser melting.

11. An method for repairing a defective signal line of a display device, wherein the defective signal line has a defect that isolates a first signal line portion from a second signal line portion of the defective signal line, the method comprising:

providing a signal driver driving a plurality of signal lines and having a driver output terminal electrically connected to the first signal line portion, and a first repair buffer having an input terminal, a control terminal and an output terminal, wherein when the control terminal receives an enable signal, activation of the first repair buffer is controlled by the enable signal applied to the first repair buffer, wherein the signal driver further comprises a second repair buffer;

providing a first lead connected to the first repair buffer and covering a first signal line and a second signal line of the signal lines;

providing a second lead connected to the second repair buffer and covering a third signal line and a fourth signal line of the signal lines, wherein the first lead does not cover the third and the fourth signal lines and the second lead does not cover the first and the second signal lines;

providing a repair line, wherein the output terminal of the first repair buffer is electrically connected to one end of the repair line, and the second repair buffer is electrically connected between the driver output terminal and the repair line;

initially electrically isolating the input terminal of the first repair buffer from the defective signal line; and for repairing the defective signal line, electrically connecting the input terminal of the first repair buffer to the defective signal line via the first lead to enable a signal from the signal driver to travel through the first repair buffer over the repair line to the second signal line portion of the defective signal line when the enable signal is applied to activate the first repair buffer.

12. The method of claim 11, further comprising: initially isolating the second signal line portion of the defective signal line from the repair line, and for repairing the defective signal line, electrically connecting the repair line to the second signal line portion.

13. The method of claim 12, wherein electrically connecting the repair line to the first signal line portion and to the second signal line portion comprises electrically connecting using laser melting to electrically connect the repair to the first and second signal line portions through an electrically insulating layer.

14. The method of claim 11, wherein wherein activation of the second repair buffer is controlled by the enable signal, the method further comprising:

activating the first repair buffer by applying the enable signal but maintaining the second repair buffer inactive to repair the defective signal line.

15. The method of claim 11, wherein the signal driver further comprises a second repair buffer electrically connected between the driver output terminal and the repair line, wherein activation of the second repair buffer is controlled by an enable signal, the method further comprising:

activating both the first and second repair buffers to electrically couple the signal on the first signal line portion to the repair line for repairing the defective signal line.

16. A flat panel display, comprising:

a panel, comprising:

a defective signal line having a first signal line portion and a second signal line portion that is isolated from the first signal line portion by a defect;

a signal driver to drive a plurality of signal lines and comprising:

a driver output terminal electrically connected to the first signal line portion;

a first repair buffer having an input terminal, a control terminal and an output terminal, wherein when the control terminal receives an enable signal, activation of the first repair buffer is controlled by the enable signal applied to the first repair buffer; and a second repair buffer;

a first lead connected to the first repair buffer and covering a first signal line and a second signal line of the signal lines;

a second lead connected to the second repair buffer and covering a third signal line and a fourth signal line of the signal line, wherein the first lead does not cover the third and the fourth signal lines and the second lead does not cover the first and the second signal lines; and a repair line, wherein the output terminal of the first repair buffer is electrically connected to one end of the repair line, and the second repair buffer is electrically connected between the driver output terminal and the repair line;

wherein the input terminal of the first repair buffer is initially electrically isolated from the defective signal line, and wherein to repair the defective signal line, the input terminal of the first repair buffer is electrically connected to the defective signal line via the first lead to enable a signal from the signal driver to travel through the first repair buffer over the repair line to the second signal line portion of the defective signal line when the enable signal activates the first repair buffer.

17. The flat panel display of claim 16, further comprising an intersection between the first lead electrically connected to the input terminal of the first repair buffer and the first signal line portion, wherein the intersection provides electrical connection between the first lead and the first signal line portion according to laser melting.

18. The flat panel display of claim 16, comprising a liquid crystal display device, wherein the panel comprises an array of thin-film transistors (TFTs) connected to data lines and scan lines, wherein the defective signal line can comprise any one of the data lines and scan lines.

19. The apparatus of claim 1, wherein when the input terminal of the first repair buffer is electrically connected to the defective signal line, if the enable signal does not activate the first repair buffer, the signal from the signal driver cannot travel through the first repair buffer over the repair line to the second signal line portion of the defective signal line.

20. The apparatus of claim 1, wherein when the input terminal of the first repair buffer is electrically connected to the defective signal line and the enable signal activates the first repair buffer, the signal voltage on the output terminal of the first repair buffer is the same as the signal voltage on the input terminal of the first repair buffer and current driving capability on the output terminal of the first repair buffer is higher than current driving capability on the input terminal of the first repair buffer.

* * * * *